United States Patent [19]

Kelly

[11] Patent Number: 4,607,426

[45] Date of Patent: Aug. 26, 1986

[54] SWAGING METHOD AND APPARATUS FOR AXIALLY EXTENDED EXPANSION OF TUBES

[75] Inventor: John W. Kelly, Burbank, Calif.

[73] Assignee: Haskel, Inc., Burbank, Calif.

[21] Appl. No.: 762,258

[22] Filed: Aug. 5, 1985

[51] Int. Cl.[4] ..... B23D 17/00; B23D 15/26; B21D 39/08

[52] U.S. Cl. ..... 29/421 R; 29/727; 29/157.4; 72/58

[58] Field of Search ..... 29/727, 421 R; 72/54, 72/56, 57, 58

[56] References Cited

U.S. PATENT DOCUMENTS

| | | | |
|---|---|---|---|
| 3,977,068 | 8/1976 | Krips | 29/421 R |
| 4,068,372 | 1/1978 | Kamohara et al. | 72/58 |
| 4,125,937 | 11/1978 | Brown et al. | 29/421 R |
| 4,152,821 | 5/1979 | Scott | 29/421 R |
| 4,210,991 | 7/1980 | Cooper | 29/421 R |
| 4,359,889 | 11/1982 | Kelly | 72/62 |
| 4,387,507 | 6/1983 | Kelly | 29/727 |
| 4,388,752 | 6/1983 | Vinciquerra et al. | 29/421 R |
| 4,414,739 | 11/1983 | Kelly | 29/727 |
| 4,418,457 | 12/1983 | Mueller | 29/727 |
| 4,502,308 | 3/1985 | Kelly | 72/58 |

*Primary Examiner*—Mark Rosenbaum
*Assistant Examiner*—Steven Nichols
*Attorney, Agent, or Firm*—Pretty, Schroeder, Brueggemann & Clark

[57] ABSTRACT

A swaging mandrel is inserted in a tube confined by a tube sheet or other surrounding structure. A pair of seals define the axial limits of a hydraulic pressure zone within the tube sheet in which radial expansion of the tube takes place in response to fluid pressure. At the secondary side of the tube sheet, an elastomeric ring extends beyond the tube sheet and, in response to the fluid pressure, produces an attenuated radial expansion force that bulges the tube to produce a tight seal at the tube sheet surface and a positive mechanical interlock between the tube and the tube sheet.

17 Claims, 2 Drawing Figures

SWAGING METHOD AND APPARATUS FOR AXIALLY EXTENDED EXPANSION OF TUBES

FIELD OF THE INVENTION

The present invention relates to swaging, and more particularly, to the swaging of tubes to form joints and to mechanically interlock the tubes with a surrounding structure such as a tube sheet.

BACKGROUND OF THE INVENTION

In many situations it is desired to expand a tube radially within a surrounding structure, thereby anchoring the tube in the desired position and forming a leak proof joint between the tube and the surrounding structure. An older traditional form of swaging is known as roller swaging, in which an implement is inserted in the tube and, as it rotates, gradually deforms the tube outwardly. However, roller swaging, while still in common use, is time consuming and is characterized by a tendency to reduce the thickness of the tube wall with accompanying elongation of the tube. It can also cause work hardening, stress induced corrosion cracking and fatigue. Preferable swaging techniques are hydraulic swaging in which fluid pressure is applied within the tube to produce radial expansion, as described in U.S. Pat. No. 4,502,308, and draw bar swaging in which elastomeric material is compressed axially, causing it to expand radially within the tube, as described in U.S. Pat. No. 4,387,507.

By properly swaging a tube, a permanent leak proof joint that is not readily subject to corrosion can be formed by eliminating spaces between the tube and the surrounding structure. A mechanical interlock can be formed between the tube and the surrounding structure to insure that the tube will not be pulled loose, even if the joint should begin to leak. The formation of a highly secure mechanical interlock is particularly important in, for example, the boiler of a ship in which many tubes pass through a tube sheet.

Frequently, a short length of tube projects from the primary side of the tube sheet and is readily accessible. This tube end is sometimes flared or belled at the primary side where the tube ends to prevent the tube from moving toward the secondary side of the tube sheet. The present invention, however, relates to the creation of an interlock at the less accessible side of the joint, normally the secondary side of the tube sheet. Here, a positive visually verifiable interlock can be created by causing an exposed portion of the tube to bulge or expand permanently to an outside diameter greater than the bore in which the tube is located. This technique is required by the U.S. Navy, which demands a bulge extending $\frac{3}{8}$ inches from the secondary side of the tube sheet.

It should be understood that the supported portion of the tube within the tube sheet or other surrounding structure can be, and frequently is, subjected to internal pressure substantially in excess of that required to burst an unsupported tube. The exposed and unsupported portion of the tube, beyond the face of the tube sheet, that is to be expanded must be limited to a significantly lower pressure. This is relatively easily accomplished by roller swaging.

An objective of the present invention is to provide an improved joint swaging technique using hydraulic forces to produce a visually verifiable mechanical interlock at the less accessible side of the joint. A further objective is to insure that no corrosion receptive crevices remain between the tube and the surrounding structure at the surface of that structure.

SUMMARY OF THE INVENTION

One aspect of the present invention relates to a method, that accomplishes the above objective, for expanding and anchoring a tube within a tube sheet or other surrounding structure to form a joint. First, a tube is inserted in a bore in the surrounding structure. A swaging mandrel is then inserted in the tube, thus defining a hydraulic pressure zone axially bounded by first and second seal members, preferably O-rings, with an elastomeric member, preferably polyurethane, disposed adjacent to the first seal member. The mandrel is positioned so that the hydraulic pressure zone is entirely within the surrounding structure. The elastomeric member it at least partially disposed within an external portion of the tube, preferably being partially within the surrounding structure as well. A pressurized fluid, preferably at a pressure exceeding the burst pressure of the tube, is introduced into the hydraulic pressure zone, preferably through the mandrel. The pressure of the fluid causes the tube to expand radially within the hydraulic pressure zone, applies an axial compressive force to the elastomeric member, which exerts a radial expansive force on the tube, and causes the external portion of the tube to permanently deform outwardly beyond the diameter of the bore, thereby positively interlocking the tube with the surrounding structure and providing visible confirmation of the integrity of the joint.

Preferably, the mandrel is inserted in such a way that the elastomeric member passes through the surrounding structure and is positioned at the opposite side thereof. A stop that engages the surrounding structure can be used to position the mandrel.

Another aspect of the present invention relates to an apparatus that can be used in carrying out the above method. It includes an elongated support encircled by first and second seal members that define the hydraulic pressure zone. An elastomeric ring adjacent to one of the seal members is compressible by hydraulic forces applied between the seals. Positioning means are provided to position the elastomeric member at least partially outside the surrounding structure, and preferably partially within the surrounding structure. A centering means, including an axially slidable sleeve, can be provided to prevent angular movement of the sealing ring nearest the elastomeric member.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figure 1:
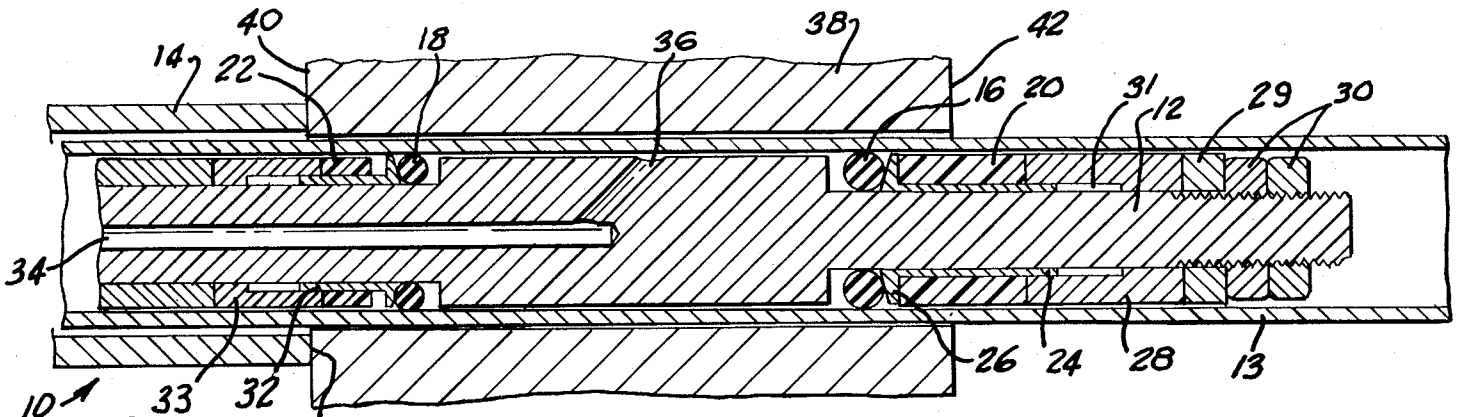
FIG. 1 is a cross-sectional view of a swaging mandrel, tube and tube sheet prior to the application of swaging pressure, the view being taken along the longitudinal axis of the apparatus and the tube.

A hand held mandrel apparatus 10, suitable for carrying out the method of the present invention and shown in FIG. 1, includes a generally cylindrical elongated steel support 12 suitable for insertion in a tube 13 to be swaged. The support 12 is attached to a head 14 provided with a stop surface 15 by which the axial position of the support within the tube 13 is determined, as explained more fully below.

First and second seal members in the form of rubber O-rings 16 and 18 encircle the support 12, defining a hydraulic pressure zone between them. On the side of each O-ring 16 and 18 away from the hydraulic pressure zone is an elastomeric ring 20 or 22, made of polyurethane, that encircles the support 12.

The first elastomeric ring 20 (which enters the tube 13 first) surrounds and rides on a steel centering sleeve 24. A flange 26 that projects radially outwardly at one end of the sleeve 24 is disposed between the adjacent O-ring 16 and the corresponding elastomeric ring 20.

At the opposite end of the elastomeric ring 20 from the O-ring 16 is a steel spacer ring 28 that prevents that elastomeric ring from sliding along the support 12 away from the pressure zone. A second steel spacer ring 29, held by a nut 30 threaded to the support 12, axially positions the first spacer 28.

The first spacer ring 28 has an undercut inner surface, thus providing an annular space 31 surrounding the support 12 which the sleeve 24 can be retracted, permitting the sleeve to slide axially along the support 12. The clearance between the sleeve 24 and the support 12 is very small in comparison to the length of the sleeve, so the sleeve cannot be cocked or moved angularly with respect to the support to any significant extent.

At the opposite end of the hydraulic pressure zone, the second elastomeric ring 22 cooperates with a centering sleeve 32 and an undercut spacer ring 33 in the same way that the first elastomeric ring 20 cooperates with the corresponding centering ring 24 and the spacer ring 28. in contrast to the first elastomeric ring 20, however, the second elastomeric ring 22 is relatively short. The second elastomeric ring 22 can also have a thinner wall thickness compared to the first elastomeric ring 20 since it need not be capable of expanding as far radially.

A fluid passage 34 extends from the head 14 through the support 12 to an opening 36 on the exterior surface of the support within the hydraulic pressure zone. A pump and pressure intensifier (not shown) are connected to the passage 34 to supply water under pressure to the hydraulic pressure zone.

The operation of the apparatus 10 in accordance with the method of the invention requires that the tube 13 to be swaged be inserted axially in the bore of a surrounding structure, such as the tube sheet 38 shown in FIG. 1. Insertion is made from the primary side 40 of the tube sheet. The bore is dimensioned to receive the tube 13 snugly, but a radial clearance between the tube and the tube sheet 38 is necessary so that the tube can be inserted without interference, taking into account the relatively high tolerances associated with the outside diameters of tubes.

Once the tube 13 has been axially positioned, it may be subjected to a preliminary swaging and anchoring step at relatively low pressure, using conventional low pressure swaging apparatus. If desired, the tube 13 may be positioned so that the end of the tube protrudes slightly from the primary side 40 and the protruding end may be flared or belled (not shown) to interlock the tube with the tube sheet 38 during this preliminary step, thus preventing the tube from moving toward the secondary side 42 of the tube sheet 38.

It should be noted that, in general, the tube 13 extends a considerable distance from the secondary side 42 of the tube sheet 38. The interior of the tube 13 on the secondary side 42 is therefore relatively inaccessible and it is more difficult to interlock the tube with the tube sheet 38 on this side to prevent movement of the tube toward the primary side 40. However, the present invention permits the tube 13 to be positively interlocked on the secondary side at the same time that relatively high pressure hydraulic swaging takes place to form a leak proof joint between the tube and the tube sheet 38.

The support 12 and associated components of the mandrel apparatus 10 are inserted axially in the tube 13 from the primary side 40 and pushed in until the stop surface 15 on the head 14 engages the tube sheet 38. The position of the stop surface 15 may be adjusted (in a manner not shown) so that it engages the primary side 40 of tube sheet 38 with the entire hydraulic pressure zone between the O-rings 16 and 18 located within the tube sheet. The first elastomeric ring 20 is partially located within the tube 13, but extends beyond into the unsupported external portion of the tube 13 that projects from the tube sheet 38.

Water under pressure is introduced through the passageway 34 into the annular volume between the support 12 and the interior surface of the tube 13. The pressure of this fluid can be well above the burst pressure of the tube 13. A typical and exemplary burst pressure might be about 12,000 psi, and the corresponding fluid pressure might be 20,000 psi or more.

Within the hydraulic pressure zone, the pressure not only deforms the tube 13 by expanding it radially, but the tube sheet 38 is also deformed by the tube to increase the size of the bore. The tube 13 deforms inelastically, but the tube sheet 38 deforms elastically. When the pressure is removed, the tube sheet 38 returns to its original shape and holds the tube 13 in a perpetual state of elastic compression.

At the end of the hydraulic pressure zone nearest the primary side 40, the second elastomeric ring 22 is compressed axially by the force of the fluid pressure and is thereby expanded radially. The corresponding centering sleeve 32 keeps the support 12 centered radially within the tube 13, thus minimizing the potential for destructive extrusion of the elastomeric ring 22, since the unsupported area of the ring is evenly distributed about its entire circumference, as explained in U.S. Pat. No. 4,359,889 entitled Self-Centering Seal For Use In Hydraulically Expanding Tubes.

Figure 2:
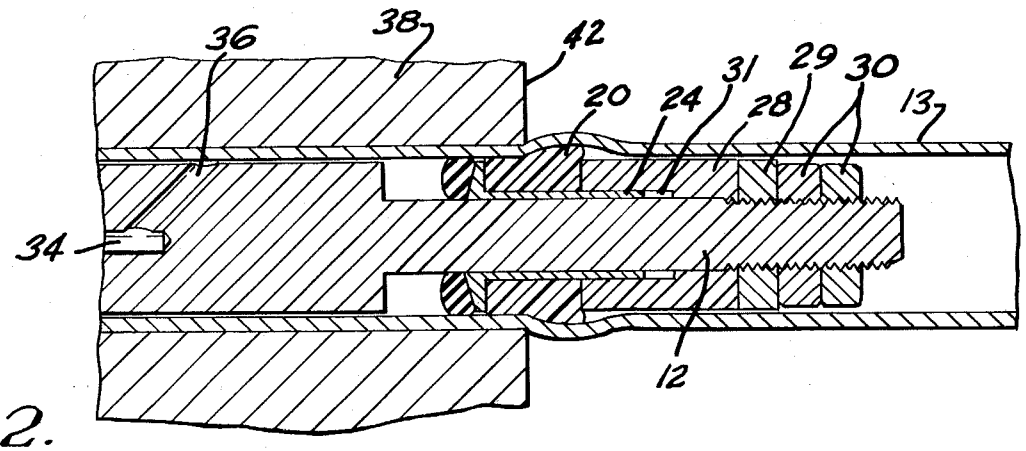
FIG. 2 is a fragmentary cross-sectional view similar to FIG. 1, showing only the right hand side of the apparatus after swaging pressure has been applied.

An expansive radial force is also exerted on the tube 13 by the first O-ring 16 and by the first elastomeric member 20, which extends outside the hydraulic pressure zone, producing a bulge 40 in the exterior portion of the tube (see FIG. 2). However, the radial force transmitted by the elastomeric member 20 is less than the fluid pressure, the amount of the reduction being a function of the configuration of the member and the material used, which determines the efficiency of the material. Generally, the efficiency of the member 20 becomes higher as the wall thickness of the member in its relaxed state increases in ratio to the wall thickness at the time and place of maximum radial expansion. It has been found that, for example, a polyurethane elastomeric member 20 having a relaxed wall thickness of 0.085 inches is suitable for an expansion to 0.110 inches, an increase of about one third.

The radial force exerted by the elastomeric member 20 also decreases with distance from the hydraulic pressure zone, apparently as an approximately linear function. Care must be taken to position the first O-ring 16 at a sufficient axial distance inwardly from the secondary side 42 of the tube sheet 38 so that the radial forces applied to the unsupported external portion of the tube 13 will not exceed the limits of the tube strength. In the accompanying drawings, only a relatively small part of the elastomeric member 20 is within the tube 13 to attenuate the pressure in the unsupported portion of the tube, but the entire mandrel apparatus 10 can be shifted to the left in FIG. 2 for greater force attenuation. If desired, the stop surface 15 can be made adjustable (in a manner not shown) to facilitate axial positioning of the apparatus 10 with respect to the tube sheet.

The greatest radial force applied to the unsupported portion of the tube 13 is applied at the secondary surface 42 of the tube sheet 38, since the force decreases axially. It is at this location that the maximum force is desired to insure a tight seal without crevices that could contribute to the onset of corrosion. A tight seal will be obtained by the method of the present invention, even if there is a slight curvature to the tube sheet 38.

It should be understood that the ability of the tube 13 to withstand internal pressure is greatest in the area closest to the tube sheet 38 where the tube is firmly supported. The pressure in this area may substantially exceed the nominal burst pressure of the tube 13. As the distance from the secondary surface 42 increases and the ability of the tube 13 to withstand pressure decreases, the pressure applied by the elastomeric member 20 also decreases. The bulge 40 of the tube 13 therefore tapers inwardly as it proceeds away from the tube sheet, as shown in FIG. 2.

The burst pressure of a tube is generally regarded as the highest internal pressure the tube will withstand over its entire length. Higher pressure can be withstood by shorter sections of the tube. Thus, the extent to which the fluid pressure must be attenuated by the elastomeric ring 22 may depend upon the axial length of the ring extending from the tube.

It will be appreciated that the present invention provides a highly efficient and reliable method and apparatus for swaging that produces a tight joint and a visually verifiable interlock within a matter of seconds.

While a particular form of the invention has been illustrated and described, it will be apparent that various modifications can be made without departing from the spirit and scope of the invention.

I claim:

1. A method for expanding and anchoring a tube within a surrounding structure to form a joint, said method comprising the steps of:

inserting said tube in a bore in said surrounding structure so that an external portion of said tube extends from said surrounding structure;

inserting a swaging mandrel in said tube, said mandrel defining a hydraulic pressure zone axially bounded by first and second seal members and an elastomeric member disposed adjacent to said first seal member;

positioning said mandrel axially within said tube so that said hydraulic pressure zone is disposed within said surrounding structure and said elastomeric member is at least partially disposed within said external portion;

introducing a pressurized fluid into said hydraulic pressure zone between said mandrel and said tube, and thus (1) causing said tube to expand radially within said hydraulic pressure zone, (2) applying an axial compressive force to said elastomeric member and thereby causing said elastomeric member to exert a radial expansive force on said tube, and (3) causing said tube to permanently deform outwardly beyond the diameter of said bore, thereby interlocking said tube with said surrounding structure and insuring a tight visually verifiable leak proof joint extending to the surface of said surrounding structure.

2. The method of claim 1 wherein said fluid is introduced through said mandrel.

3. The method of claim 1 wherein said elastomeric member is partially disposed within said bore.

4. The method of claim 1 wherein said surrounding structure is a tube sheet.

5. The method of claim 1 wherein said mandrel is inserted in said tube in such a way that said elastomeric member passes through said surrounding structure and is positioned at the opposite side thereof.

6. The method of claim 5 wherein said mandrel is positioned with respect to said surrounding structure by bringing a stop member into contact with said surrounding structure.

7. The method of claim 1 wherein said fluid is introduced at a pressure exceeding the burst pressure of said tube.

8. The method of claim 1 wherein:

said elastomeric member is partially disposed within said bore; and said fluid is introduced at a pressure exceeding the burst pressure of said tube.

9. The method of claim 1 wherein:

said mandrel is inserted in said tube in such a way that said elastomeric member passes through said surrounding structure and is positioned at the opposite side thereof, partially disposed within said bore; and said fluid is introduced at a pressure exceeding the burst pressure of said tube.

10. A method for expanding and anchoring a tube within a tube sheet to form a joint, said method comprising the steps of:

inserting said tube in a bore in said tube sheet so that an external portion of said tube extends from the secondary side of said tube sheet;

inserting a swaging mandrel in said tube from the primary side of said tube sheet, said mandrel defining a hydraulic pressure zone axially bounded by first and second seal members and an elastomeric ring disposed adjacent to said first seal member;

causing a stop attached to said mandrel to contact said primary side of said tube sheet and thereby positioning said mandrel so that said hydraulic pressure zone is entirely within said tube sheet and said elastomeric ring is positioned partially within said tube sheet and partially within said external portion of said tube;

introducing a pressurized fluid at a pressure exceeding the burst pressure of said tube into an annular volume between said mandrel and said tube corresponding to said hydraulic pressure zone and thus (1) causing said tube to expand radially within said hydraulic pressure zone, (2) applying an axial compressive force to said elastomeric ring and thereby causing said elastomeric ring to exert a radial expansive force on said tube that decreases with increasing distance from said hydraulic pressure zone, and (3) causing said tube to permanently deform outwardly beyond the diameter of said bore, thereby interlocking said tube with said tube sheet and insuring a tight visually verifiable leak proof joint extending to the surface of said surrounding structure.

11. An apparatus for expanding and anchoring a tube within a surrounding structure to form a joint, said apparatus comprising:

an elongated support for insertion in said tube;

first and second sealing rings encircling said support for engaging the inside surface of said tube and thus defining a hydraulic pressure zone extending axially through a portion of said tube, said second seal being axially slidable along a portion of said support;

expansion means for expanding a portion of said tube outside said surrounding structure and adjacent to the surface of said surrounding structure, said expansion means comprising an elastomeric ring encircling said support and disposed outside said hydraulic pressure zone and closer to said first seal than said first seal, whereby hydraulic pressure within said zone causes axial compression and radial expansion of said elastomeric ring;

a passageway extending through said support to a location on the surface of said support between said sealing rings; and positioning means attached to said support nearer to said second seal ring than said first seal ring for positioning said support with respect to said surrounding structure such that said seal rings are disposed within said surrounding structure and said elastomeric ring is at least partially disposed outside said surrounding structure.

12. The apparatus of claim 11 wherein said positioning means causes said elastomeric ring to be disposed partially within said surrounding structure.

13. The apparatus of claim 11 further comprising centering means for preventing angular movement of said second seal ring relative to the longitudinal axis of said support.

14. The apparatus of claim 11 further comprising centering means for preventing angular movement of said second seal ring relative to the longitudinal axis of said support, said centering means comprising a sleeve that is axially slidable on said support, said sleeve having a flange that extends radially outwardly between said second seal ring and said elastomeric ring.

15. The apparatus of claim 14 wherein said first and second seal means are O-rings and said elastomeric ring is polyurethane.

16. The apparatus of claim 11 wherein said first and second seal means are O-rings and said elastomeric ring is polyurethane.

17. The apparatus of claim 1 further comprising an elastomeric back-up member encircling said support adjacent to said second ring to prevent destructive extrusion of said second seal ring, said back-up member being shorter.

* * * * *

UNITED STATES PATENT AND TRADEMARK OFFICE

CERTIFICATE OF CORRECTION

PATENT NO. : 4,607,426

DATED : August 26, 1986

INVENTOR(S) : John W. Kelly

It is certified that error appears in the above-identified patent and that said Letters Patent is hereby corrected as shown below:

In column 2, line 19, delete "it" and insert therefor -- is --.

In column 8, line 31, delete "1" and insert therefor -- 11 --.

Signed and Sealed this

Thirtieth Day of December, 1986

*Attest:*

DONALD J. QUIGG

*Attesting Officer*

*Commissioner of Patents and Trademarks*